US011703298B1

(12) United States Patent
Hsu

(10) Patent No.: US 11,703,298 B1
(45) Date of Patent: Jul. 18, 2023

(54) RUST PREVENTION DEVICE FOR GUN

(71) Applicant: Tsang-Hung Hsu, Tainan (TW)

(72) Inventor: Tsang-Hung Hsu, Tainan (TW)

( * ) Notice: Subject to any disclaimer, the term of this patent is extended or adjusted under 35 U.S.C. 154(b) by 0 days.

(21) Appl. No.: 17/648,344

(22) Filed: Jan. 19, 2022

(51) Int. Cl.
*F41A 35/04* (2006.01)
*F41A 17/44* (2006.01)

(52) U.S. Cl.
CPC ..... *F41A 35/04* (2013.01); *F41A 17/44* (2013.01)

(58) Field of Classification Search
CPC ..... F41A 17/44; F41A 35/04
See application file for complete search history.

(56) References Cited

U.S. PATENT DOCUMENTS 388,804 A * 8/1888 Wooster ..... F41A 35/04 89/31
540,748 A * 6/1895 Layton ..... F41A 35/04 89/31
2,465,163 A * 3/1949 Lockwood ..... F41A 29/00 89/31
2,557,277 A * 6/1951 Gibson ..... F41A 29/00 96/151
2,558,792 A * 7/1951 Snowden ..... F41A 35/04 89/31
2,594,778 A * 4/1952 Hoard ..... F41A 29/00 89/31
2,943,411 A * 7/1960 Salva ..... F41A 17/44 42/70.11
2,983,063 A * 5/1961 Douville ..... F41A 35/04 42/96
2,985,979 A * 5/1961 Doyle ..... F41A 17/44 42/96
3,849,923 A * 11/1974 Hawkins ..... F42B 5/24 42/96
4,054,002 A * 10/1977 Latona, Jr. ..... F41A 35/04 42/96
4,084,340 A * 4/1978 Scudder ..... F41A 35/04 42/96
6,708,438 B1 * 3/2004 Sorensen ..... F41A 29/00 42/70.11
7,234,264 B2 * 6/2007 Cole ..... F41A 35/04 42/106
7,963,063 B2 * 6/2011 Camarillo ..... F41A 35/04 42/96

(Continued)

FOREIGN PATENT DOCUMENTS

GB 596261 A 12/1947

*Primary Examiner* — Joshua E Freeman
(74) *Attorney, Agent, or Firm* — Rosenberg, Klein & Lee

(57) ABSTRACT

A rust prevention device for guns which includes a mounting case with a mounting space and a bullet-shaped rust prevention plug mounted in the mounting space is revealed. An outer diameter of the rust prevention plug is sized to fit in a bore or a magazine of the gun. A main body of the rust prevention plug which is a molded block made of porous adsorbents or volatile corrosion inhibitors (VCIs) is exposed outside the mounting case. Thereby the rust prevention device is loaded into the bore or magazine like a cartridge and the main body of the rust prevention plug is exposed to increase surface area in contact with air in the gun. The rust prevention plug has more contact with metal parts in the gun due to diffusion in air. Therefore, the gun is better protected against rust.

14 Claims, 9 Drawing Sheets

(56) References Cited

U.S. PATENT DOCUMENTS

| | | | | |
|---|---|---|---|---|
| 8,713,842 | B1 * | 5/2014 | Frick | F41A 35/04<br>42/106 |
| 2008/0069989 | A1 * | 3/2008 | Hammill | B29C 45/0001<br>264/328.17 |
| 2020/0096282 | A1 * | 3/2020 | Taylor | F42B 5/24 |

* cited by examiner

RUST PREVENTION DEVICE FOR GUN

BACKGROUND OF THE INVENTION

Field of the Invention

The present invention relates to a rust prevention device for guns, especially to a rust prevention device for guns used to protect metal parts inside the gun such as a bore, a magazine, etc. from rust.

Description of Related Art

So-called pitting is a lot of tiny rust spots inside a barrel of a gun caused by poor maintenance and cleaning. Black powder left uncleaned after shooting is highly corrosive after absorption of water in air so that oxidization occurs in steel of a gun barrel and rust shows up. The rust and pitting are caused by the use of corrosive ammunition which is ammunition that uses a primer with chemicals (mercury fulminate and potassium chlorate). After combustion of the primer, potassium chloride produced has properties similar to salt (sodium chloride), both having strong hygroscopic nature. Once the potassium chloride is attached to the bore to absorb water from air, corrosion and rust occurs.

Most of the guns available now have a bluing layer and many people think that the bluing layer protects metal parts of the gun against rust like stainless steel. In fact, the bluing layer is only a black oxide coating formed on surface of metal for adhesion of oil substances. Thereby rust is delayed by the oil substances which block moisture. However, duration of such action is not long and regular cleaning and oiling by gun users are required. Yet the cleaning and maintenance process is complicated and trivial. Thus the metal parts of the gun are easy to rut once the maintenance is not done right or completely. Therefore, not only the next shooting will be affected, people may also get injured or killed.

Refer to Publication No. GB596261 A, improvements in or relating to moisture-absorbing apparatus for a barrel of a firearm are revealed. The barrel of the firearm is protected against rust by means of a container, enclosing solid moisture absorbing material in bulk and covering the end of the barrel and is perforated to communicate with the inside of the barrel. The container may be made of a transparent plastic and having moisture absorbing material indicating moisture by colour changes. Thus the condition of the moisture absorbing material may be seen without opening the container. However, the solid moisture absorbing material is enclosed in a sealed plastic container completely. In order to prevent leak of the solid moisture absorbing material, the container is perforated to communicate with the inside of the barrel at a rear end thereof and a diameter of a perforated hole must be smaller than particle size of the solid moisture absorbing material. The perforated hole is used as the only channel communicating with the barrel so that a contact area between the solid moisture absorbing material and air in the barrel is extremely limited and this apparatus has the shortcoming of limited moisture removal and poor rust prevention.

SUMMARY OF THE INVENTION

Therefore, it is a primary object of the present invention to provide a rust prevention device for guns used to protect metal parts inside the gun such as a bore, a magazine, etc. from rust.

In order to achieve the above object, a rust prevention device for guns according to the present invention mainly includes a mounting case with a mounting space and a bullet-shaped rust prevention plug mounted in the mounting space. An outer diameter of the mounting case is configured to fit in the bore or magazine of the gun. The rust prevention plug is a molded block made of powder particles of porous adsorbents or volatile corrosion inhibitors (abbreviated as VCI) mixed with adhesives. One end of the rust prevention plug is mounted and fixed in the mounting space of the mounting case and a main body of the rust prevention plug is exposed outside the mounting case. Thereby the mounting case and the rust prevention plug are connected to each other to form the cartridge-shaped rust prevention device which is capable of being loaded into the bore and the magazine of the gun like a cartridge. A surface of the main body of the bullet-shaped rust prevention plug is exposed in the bore or the magazine so that a surface area of the rust prevention plug in contact with air in the gun is increased. The rust prevention plug also has more contact with metal parts in the gun due to diffusion in air. Therefore, better rust protection inside the gun is achieved.

One end of the mounting case is provided with a sandwich member which is having at least one through hole therein for communicating with the mounting space of the mounting case.

A moisture-sensitive color-changing member which a film attached with chemical agents changing colors in response to moisture such as cobalt chloride is mounted in the sandwich member. The moisture-sensitive color-changing member is covered by a transparent window cap which is used for checking color changes of the moisture-sensitive color-changing member.

A first protruding portion is disposed on an inner surface of the mounting case and the rust prevention plug is provided with a locking path which is corresponding to the first protruding portion and used for limiting the rust prevention plug within the mounting space.

A plurality of ribs with a plurality of air channels is disposed around the rust prevention plug. An outer diameter of the circularly arranged ribs around the rust prevention plug is configured to fit in an inner diameter of a barrel. When the molded bullet-shaped rust prevention device is loaded into the bore of the barrel and attached closely to an inner wall of the barrel, a gap between the two adjacent ribs around the rust prevention plug constitutes the air channel to increase surface area of the rust prevention plug exposed in the barrel. The rust prevention plug has more contact with the respective metal parts in the gun due to diffusion in air so that rust prevention effect is improved.

The rust prevention plug is made of the powder particles of porous adsorbents which are mixed with adhesives, molded into the bullet-shaped blocks, and formed after baking.

The rust prevention plug is made of the powder particles of volatile corrosion inhibitors (VCIs) which are mixed with adhesives and then molded into the bullet-shaped blocks.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
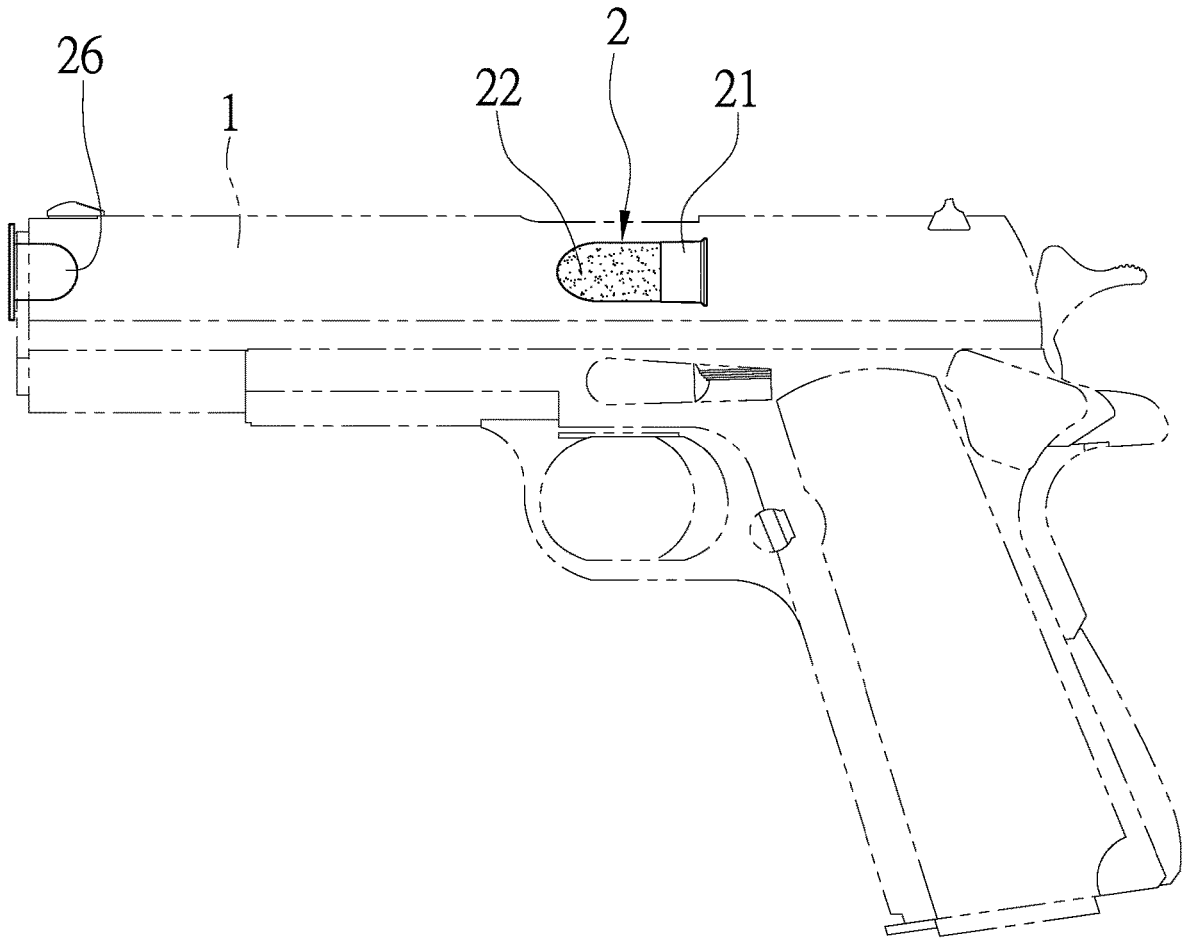
FIG. 1 is a schematic drawing showing an embodiment of a rust prevention device mounted in a gun according to the present invention.

Refer to FIGS. 1-4, schematic drawings showing a rust prevention device for guns are revealed. A bore or a magazine of a gun 1 is mounted with at least one rust prevention device 2 which is configured to fit in the bore or the magazine of the gun 1 and composed of a mounting case 21 and a rust prevention plug 22.

The mounting case 21 is provided with a mounting space 211 formed in one end thereof and having an outer diameter sized to fit within the bore or the magazine of the gun 1.

The bullet-shaped rust prevention plug 22 is a molded block made of powder particles mixed with adhesives. One end of the rust prevention plug 22 is mounted and fixed in the mounting space 211 of the mounting case 21 while the other end thereof is exposed outside the mounting case 21 and configured to fit in the bore or the magazine of the gun 1 correspondingly.

It should be noted that the mounting case 21 has the outer diameter sized to fit within the bore or magazine of the gun 1 so that the rust prevention device 2 is sized and configured to fit in the bore or magazine of the gun 1. The rust prevention device 2 further includes a moisture-sensitive color-changing member 23 and a transparent window cover 24. The moisture-sensitive color-changing member 23 which is a film attached with chemical agents changing colors in response to moisture (such as cobalt chloride) is disposed on the other end of the mounting case 21. The other end of the mounting case 21, opposite the end with the mounting space 211, is provided with a sandwich member 212 which is having at least one through hole 213 therein for communicating with the mounting space 211 of the mounting case 21. The moisture-sensitive color-changing member 23 is mounted in the sandwich member 212 and covered by the transparent window cap 24 which is used for checking color changes of the moisture-sensitive color-changing member 23 in order to determine whether the rust prevention plug 22 should be replaced.

There are several manufacturing processes of the rust prevention plug 22 while being implemented. For example, an adsorbent such as silica gel, zeolite, diatomaceous earth, activated aluminum oxide, activated carbon is selected and milled into powder particles. Then the powder particles are mixed with adhesives to form a mixture which is molded into bullet-shaped blocks and formed after baking. The adsorbent is a porous material with strong physical adsorption force due to higher specific surface area. The physical adsorption force is a kind of intermolecular force that exists between adsorbents and adsorbents, known as van der Waals force. That means water molecules are adsorbed by the adsorbent and then removed to prevent rust. In another example, powder particles of volatile corrosion inhibitors (abbreviated as VCIs) is used as main raw material which is mixed with adhesives and then molded into bullet-shaped blocks. The VCIs evaporate or sublimate at room temperature and then migrate via a gas phase to a metal surface to be protected and form a dense protection film on the metal surface following adsorption. Thus protection of metal such as steel against rust is rendered. In a further example, porous adsorbents and VCIs are mixed with each other, blended with adhesives, and then molded into blocks. The above three examples are among multiple implementable processes of the present rust prevention device.

The following two embodiments show how the mounting case 21 and the rust prevention plug 22 are connected.

Figure 2:
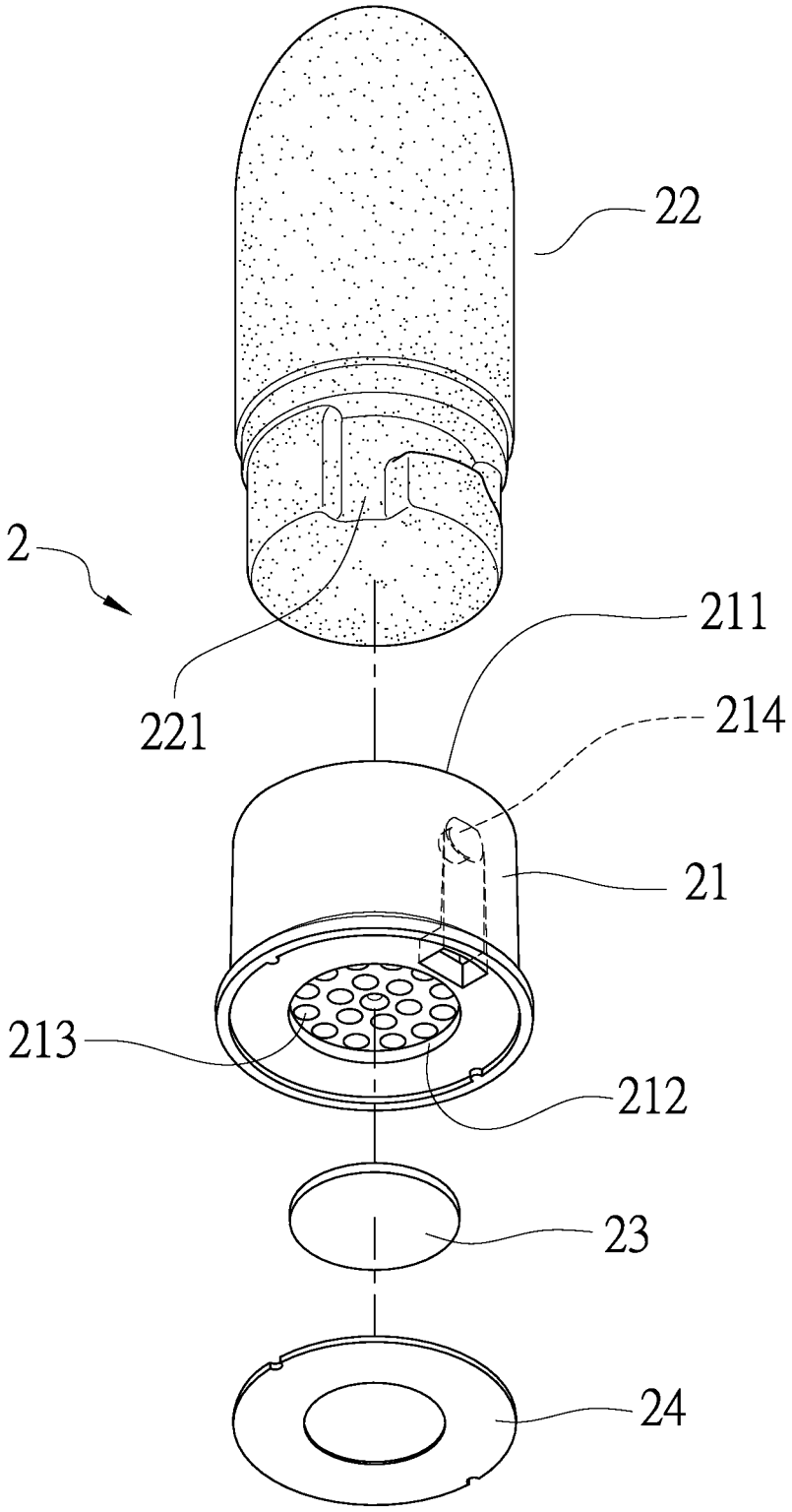
FIG. 2 is an exploded view of an embodiment of a rust prevention device according to the present invention.
Figure 3:
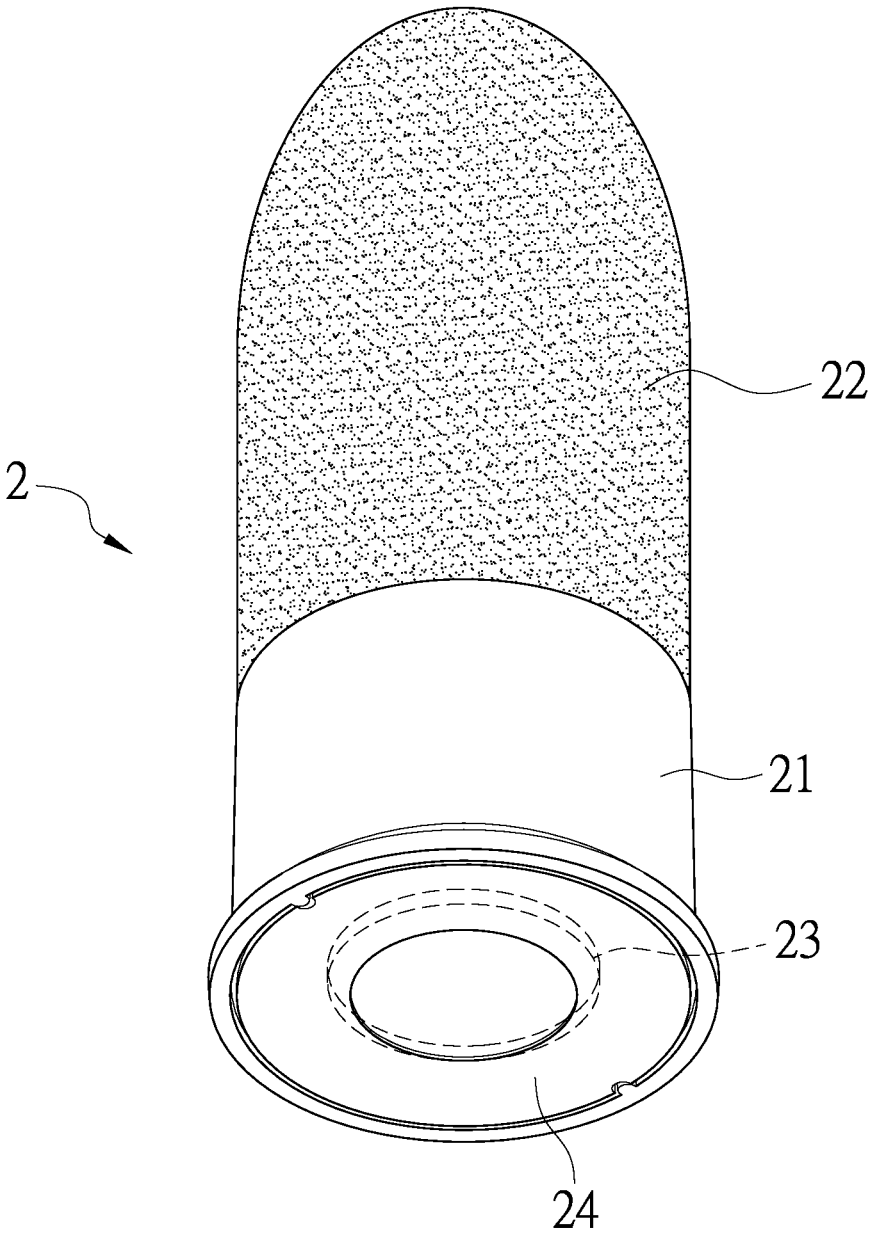
FIG. 3 is a perspective view of an embodiment of a rust prevention device according to the present invention.
Figure 4:
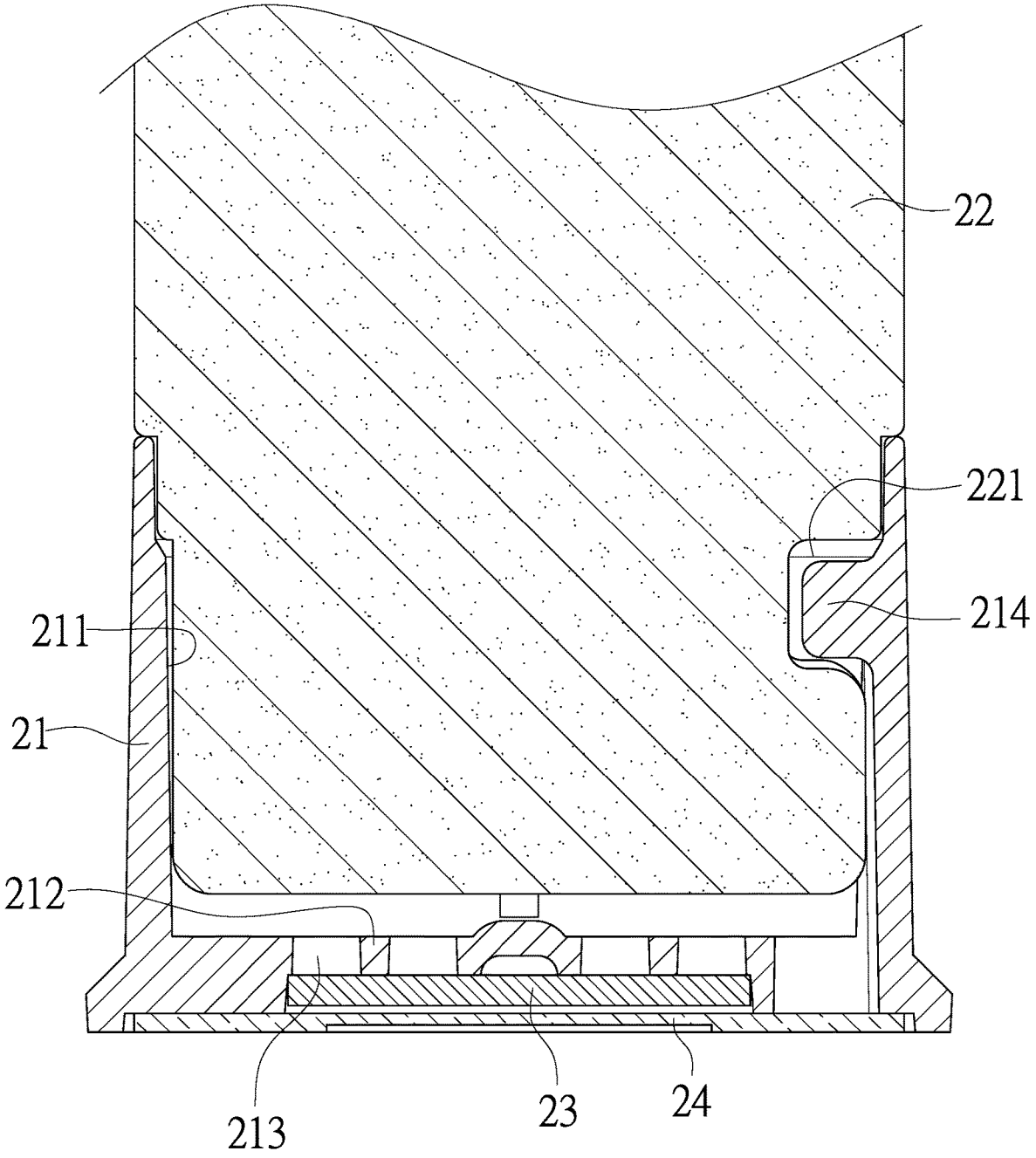
FIG. 4 is a schematic drawing showing a partial sectional view of an embodiment of a rust prevention device according to the present invention.

Please refer to the first embodiment shown in FIG. 2, FIG. 3, and FIG. 4, a first protruding portion 214 is disposed on an inner surface of the mounting case 21 and the rust prevention plug 22 is provided with a locking path 221 which is corresponding to the first protruding portion 214 and used for limiting the rust prevention plug 22 within the mounting space 211. When the rust prevention plug 22 is mounted into the mounting space 211 of the mounting case 21, the first protruding portion 214 is guided into an opening of the locking path 221 and moved along the locking path 221 so as to limit and fix the rust prevention plug 22 in the mounting space 211.

Figure 5:
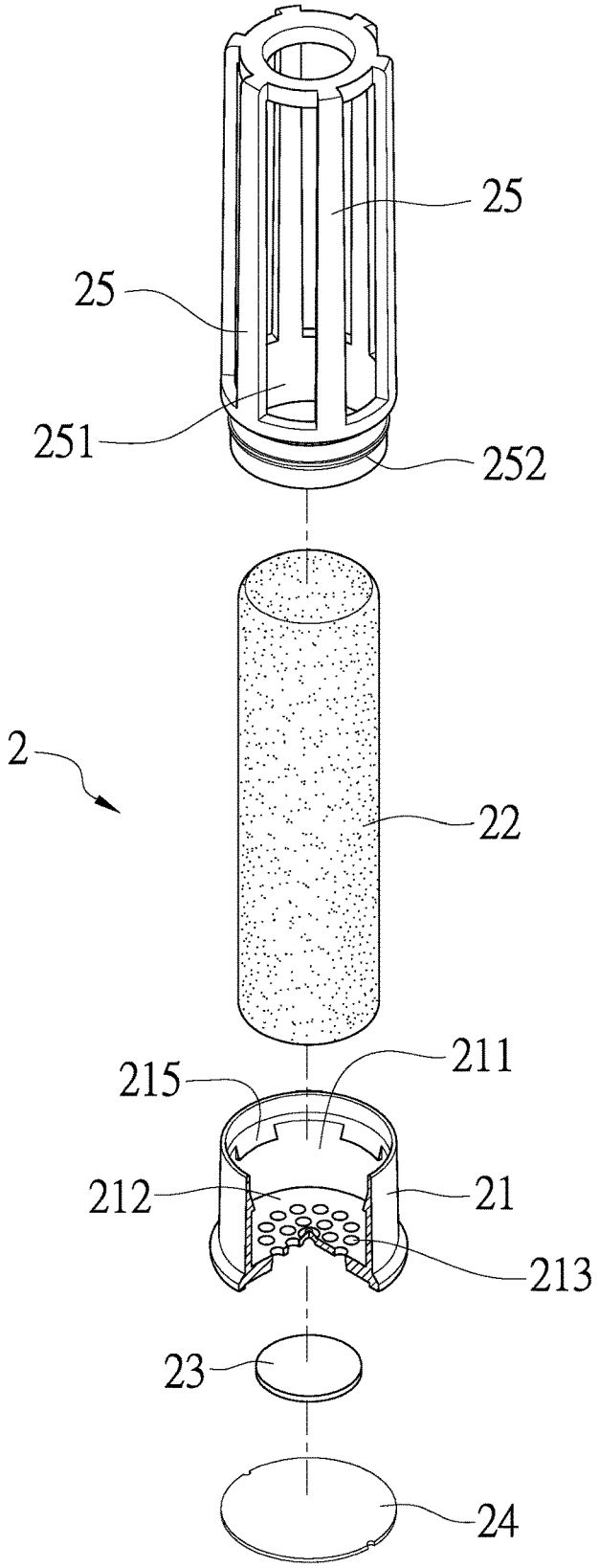
FIG. 5 is an exploded view of another embodiment of a rust prevention device according to the present invention.
Figure 6:
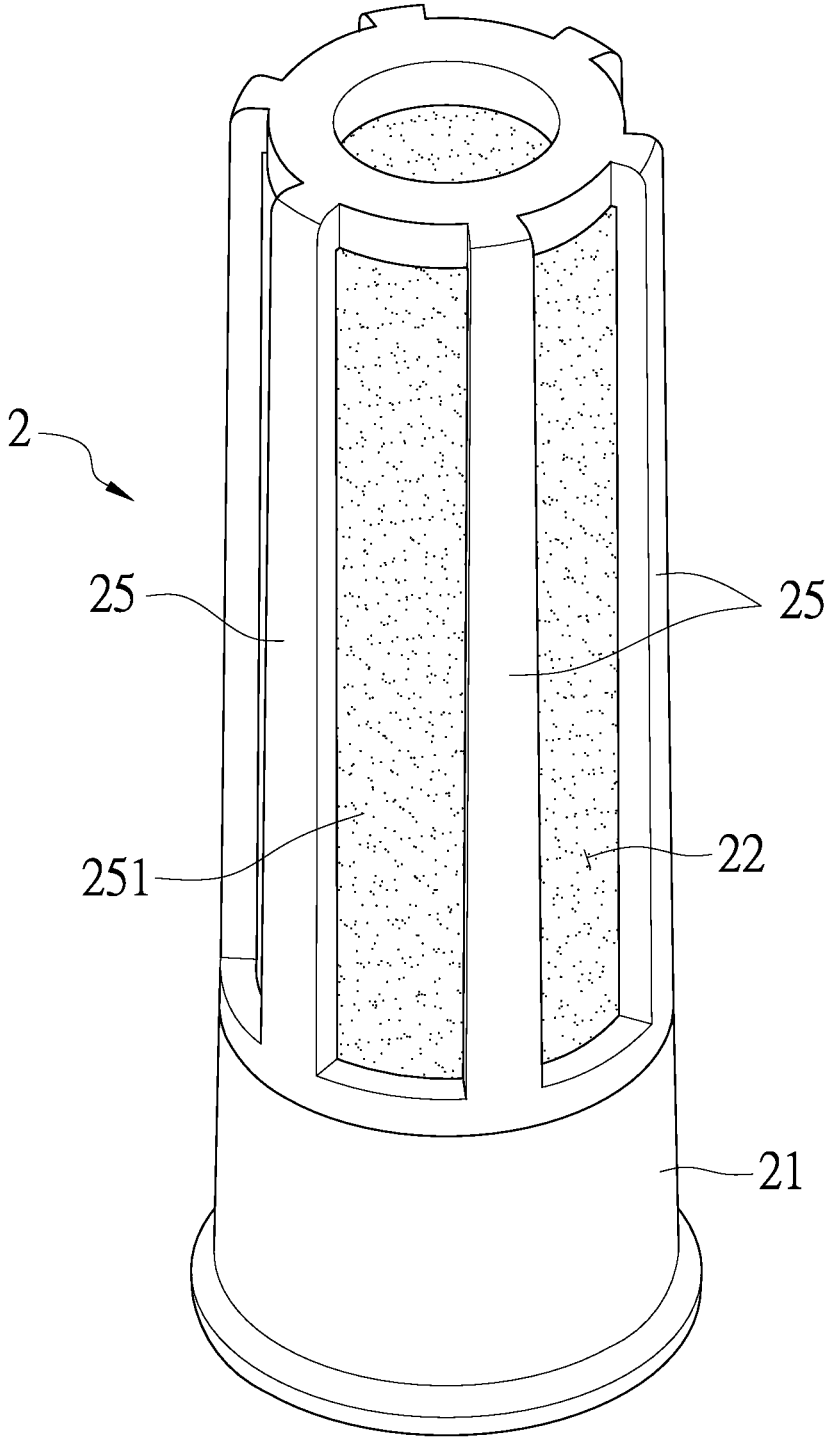
FIG. 6 is a perspective view of another embodiment of a rust prevention device according to the present invention.
Figure 7:
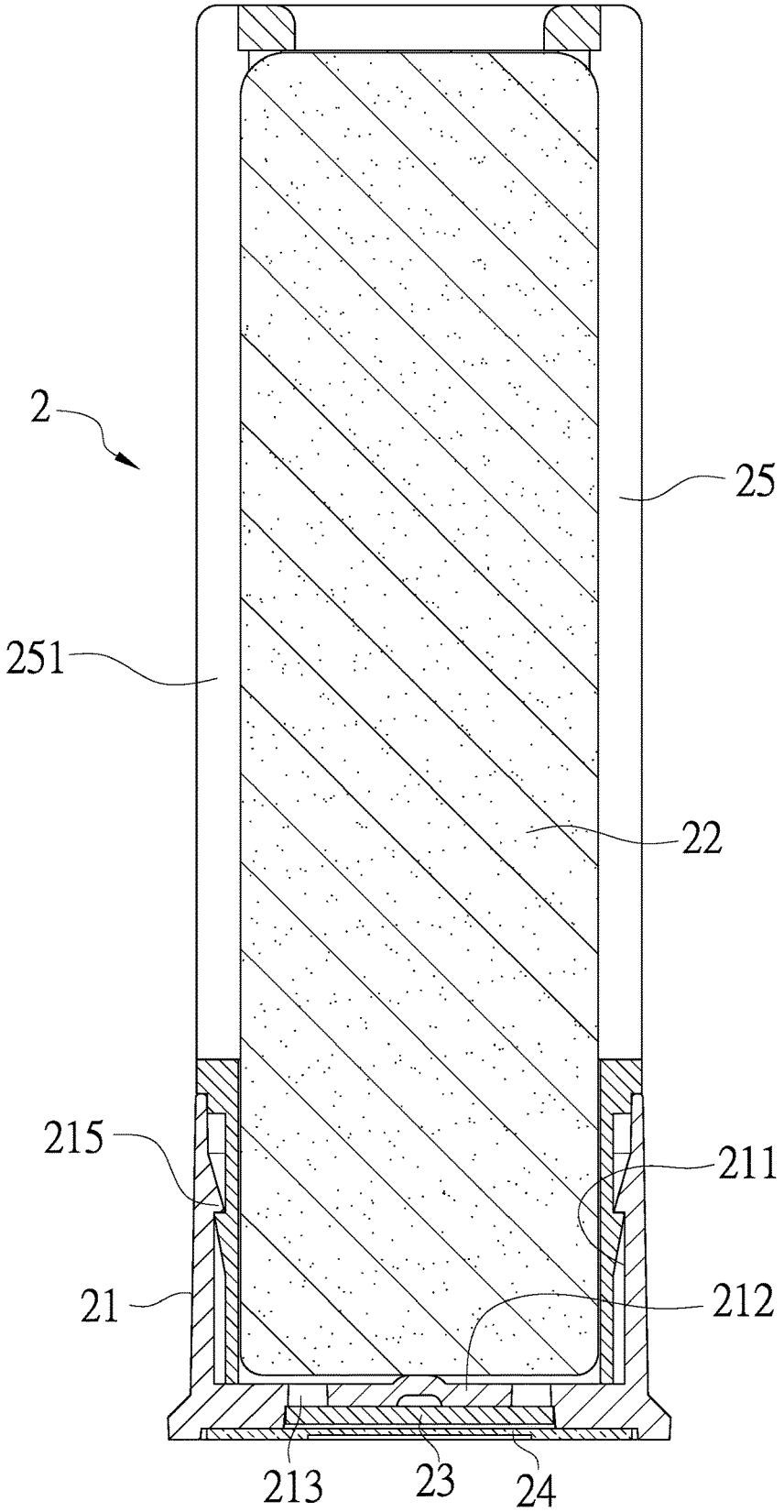
FIG. 7 is a schematic drawing showing a sectional view of another embodiment of a rust prevention device according to the present invention.
Figure 8:
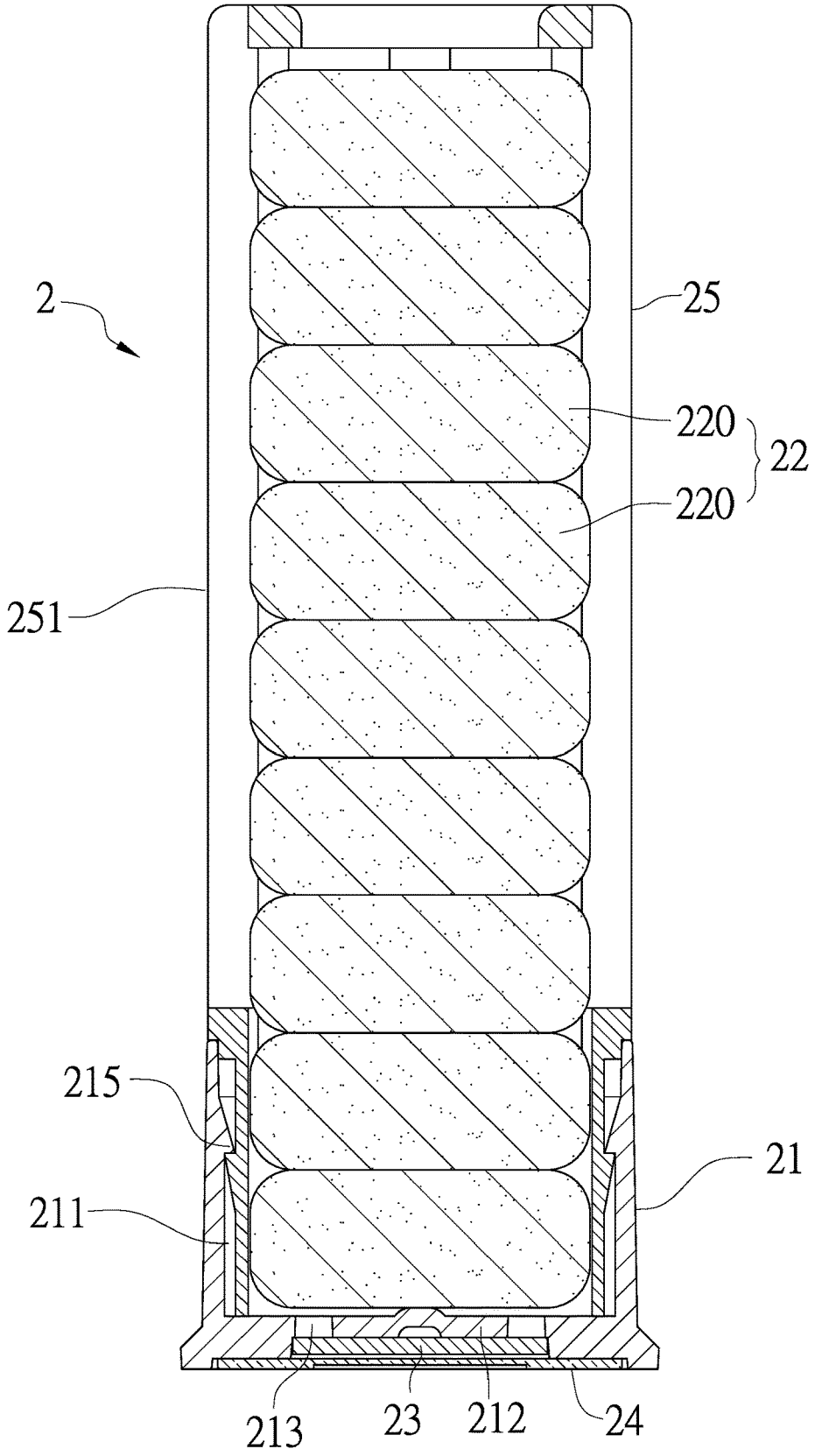
FIG. 8 is a schematic drawing showing a sectional view of a further embodiment of a rust prevention device according to the present invention.

Refer to the second embodiment shown in FIG. 5, FIG. 6, and FIG. 7, a plurality of lengthwise ribs 25 with a plurality of air channels 251 is disposed around a rust prevention plug 22 and each of the air channels 251 is formed between the two adjacent lengthwise ribs 25. An outer diameter of the circularly arranged ribs 25 around the rust prevention plug 22 is configured to fit in an inner diameter of a barrel of the gun 1. As shown in FIG. 8, the rust prevention plug 22 is further formed by a plurality of rust prevention units 220 stacked on one another and enclosed in the ribs 25. When the rust prevention device 2 is loaded into the bore and attached closely to an inner wall of the barrel, a gap between the two adjacent ribs 25 around the rust prevention plug 22 constitutes the air channel 251 to increase exposure area of the rust prevention plug 22 in the barrel. Owing to diffusion in air, the rust prevention plug 22 also has more contact with metal parts in the gun 1. Thus rust prevention performance is enhanced.

It is further explained that the ribs 25 are mainly used to form the air channels 251. As shown in FIG. 6, the ribs 25 are formed by extension of the mounting case 21. The ribs 25 can also be made of the same rust prevention material as the rust prevention plug 22 and integrated with the rust prevention plug 22 by molding. It should be noted that how the air channels 251 are produced is not the main point of the present invention as long as the air channels 251 are formed outside the rust prevention plug 22 by the ribs 25.

As shown in FIG. 5, a locking portion 252 is disposed on one end of the ribs 25 around the rust prevention plug 22 while a second protruding portion 215 corresponding to the locking portion 252 is arranged at an inner surface of the mounting case 21 and able to be engaged with the locking portion 252. While being assembled, the locking portion 252 is mounted in and engaged with the second protruding portion 215 of the mounting case 21 so that the ribs 25 are located around the rust prevention plug 22.

In an embodiment of the rust prevention device 2 according to the present invention, one end of the rust prevention plug 22 is mounted and fixed inside the mounting space 211 on one end of the mounting case 21 while a main body of the rust prevention plug 22 is exposed outside the other end of the mounting case 21 when the rust prevention plug 22 made of porous adsorbent is used for adsorption of moisture inside the gun 1. The moisture-sensitive color-changing member 23 is placed into the sandwich member 212 of the mounting case 21 for detecting changes in moisture content of the rust prevention plug 22 and further having changes in color. The sandwich member 212 is provided with at least one through hole 213 therein by which the sandwich member 212 and the mounting space 211 are communicating with each other for allowing detection of the changes in the moisture content of the rust prevention plug 22.

By the rust prevention plug 22 mounted and connected to the mounting case 21, the cartridge-shaped rust prevention device 2 formed is loaded into the bore or magazine like a cartridge. An outer diameter of the rust prevention device 2 is configured to fit in an inner diameter of the bore or magazine. In the above two embodiments, the outer diameter of the rust prevention plug 22 or the ribs 25 included in the rust prevention device 2 is sized to fit in the inner diameter of the bore or magazine. Thereby the main body of the rust prevention plug 22 is exposed inside the bore and the magazine so that a surface area of the rust prevention plug 22 in contact with air in the gun 1 is increased and the rust prevention plug 22 has more contact with the metal parts in the gun 1 due to diffusion in air. Thereby broader prevention against rust inside the gun 1 is achieved. At the same time, users can observe adsorption of the moisture through the transparent window cap 24 to replace the rust prevention plug 22 in time or treat the rust prevention plug 22 to get moisture adsorption capacity again for excellent and continuous rust prevention.

Figure 9:
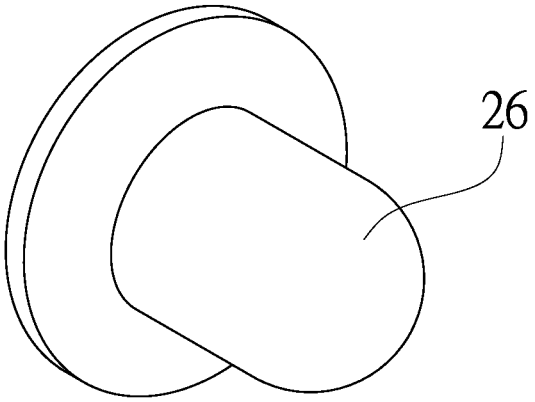
FIG. 9 is a perspective view of a muzzle plug of an embodiment of a rust prevention device according to the present invention.

Refer to FIG. 1 and FIG. 9, it should be noted that the rust prevention device 2 further includes a muzzle plug 26 in order to ensure optimal rust prevention of the gun 1. The muzzle plug 26 which is sized to fit in an inner diameter of the barrel is mounted in an opening at an end of the barrel for sealing space in the barrel and preventing moisture from entering the barrel of the gun 1. Thereby the protection against rust offered by the rust prevention plug 22 is enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A rust prevention device for guns which is loaded into the gun while in use, the rust prevention device comprising:

a mounting case provided with a mounting space formed at one end thereof and configured to fit in a bore or a magazine of the gun; and a rust prevention plug, the rust prevention plug being a molded block having an outer diameter corresponding to an inner diameter of the bore of the magazine of the gun and fabricated of powder particles mixed with at least one adhesive and having one end of the rust prevention plug mounted and fixed in the mounting space of the mounting case with another end of the rust prevention plug exposed longitudinally outside the mounting space of the mounting case, wherein the rust prevention plug and the mounting case, after being connected with one another, are loaded into the bore or the magazine of the gun for rust prevention in the gun.

2. The rust prevention device for guns as claimed in claim 1, wherein a sandwich member is arranged at another end of the mounting case and is provided with at least one through hole formed therein for communicating with the mounting space of the mounting case, and wherein a moisture-sensitive color-changing member is mounted in the sandwich member of the mounting case and covered by a transparent window cap for visual detection of color changes of the moisture-sensitive color-changing member.

3. The rust prevention device for guns as claimed in claim 1, wherein a first protruding portion is disposed on an inner surface of the mounting case and the rust prevention plug is provided with a locking path which is corresponding to the first protruding portion and used for limiting the rust prevention plug within the mounting space.

4. The rust prevention device for guns as claimed in claim 1, wherein the rust prevention plug is fabricated of the powder particles of at least one porous adsorbent, and the powder particles of the porous adsorbent are molded into the blocks and baked to form the rust prevention plug.

5. The rust prevention device for guns as claimed in claim 1, wherein the rust prevention plug is made of the powder particles of at least one volatile corrosion inhibitor (VCI).

6. The rust prevention device for guns as claimed in claim 1, further including a muzzle plug configured to fit in a barrel of the gun, the muzzle plug being mounted into an opening at an end of the barrel of the gun for sealing space in the barrel of the gun and preventing moisture from entering the barrel of the gun to enhance rust prevention of the rust prevention plug.

7. A rust prevention device for guns which is loaded into the gun while in use, the rust prevention device comprising:

a mounting case provided with a mounting space formed at one end thereof and configured to fit in a bore or a magazine of the gun;

a rust prevention plug fabricated as a molded block of powder particles mixed with at least one adhesive, the rust prevention plug having one end of the rust prevention plug mounted and fixed in the mounting space of the mounting case, and another end of the rust prevention plug exposed outside the mounting space of the mounting case, wherein the rust prevention plug and the mounting case, after being connected with one another, are loaded into the bore or the magazine of the gun for prevention of rust in the gun; and a plurality of ribs with a plurality of air channels disposed around the rust prevention plug, wherein each of the air channels is formed between the two adjacent ribs, and the ribs are configured to fit in a barrel of the gun, wherein a locking portion is formed at one end of the ribs in a surrounding relationship with the rust prevention plug, and a second protruding portion is arranged at an inner surface of the mounting case, the second protruding portion corresponding to the locking portion for removable engagement therewith.

8. The rust prevention device for guns as claimed in claim 7, wherein the mounting case is configured with a sandwich member arranged at another end of the mounting case and provided with at least one through hole therein for communicating with the mounting space of the mounting case.

9. The rust prevention device for guns as claimed in claim 8, further including a moisture-sensitive color-changing member mounted in the sandwich member of the mounting case and covered by a transparent window cap used for visual detection of color changes of the moisture-sensitive color-changing member.

10. The rust prevention device for guns as claimed in claim 9, further including a muzzle plug configured to fit in a barrel of the gun, the muzzle plug being mounted into an opening at an end of the barrel of the gun for sealing space in the barrel of the gun and preventing moisture from entering the barrel of the gun to enhance rust prevention of the rust prevention plug.

11. The rust prevention device for guns as claimed in claim 7, wherein the rust prevention plug is formed by a plurality of rust prevention units.

12. The rust prevention device for guns as claimed in claim 7, wherein the rust prevention plug is made of the powder particles of at least one porous adsorbent, and wherein the powder particles of the porous adsorbent are molded into the blocks and baked to form the rust prevention plug.

13. The rust prevention device for guns as claimed in claim 7, wherein the rust prevention plug is made of the powder particles of at least one volatile corrosion inhibitor (VCI).

14. The rust prevention device for guns as claimed in claim 7, wherein the ribs are made of the same material as the rust prevention plug and integrated with the rust prevention plug by molding.

* * * * *